United States Patent [19]

Bockhorst et al.

[11] 4,452,075

[45] Jun. 5, 1984

[54] PUSH DRILL GUIDANCE INDICATION APPARATUS

[75] Inventors: Rhea W. Bockhorst, Morgantown, W. Va.; Jimmie H. Elenburg, Ponca City, Okla.

[73] Assignee: Conoco Inc., Ponca City, Okla.

[21] Appl. No.: 422,572

[22] Filed: Sep. 24, 1982

Related U.S. Application Data

[63] Continuation-in-part of Ser. No. 89,008, Oct. 29, 1979.

[51] Int. Cl.[3] ..... G01V 1/40; E21B 47/02

[52] U.S. Cl. ..... 73/151; 33/312; 33/313; 175/45; 299/1; 367/81; 340/858

[58] Field of Search ..... 73/151; 33/312, 313; 299/1; 175/45; 367/81; 340/858

[56] References Cited

U.S. PATENT DOCUMENTS

| | | | |
|---|---|---|---|
| 3,907,045 | 9/1975 | Dahl et al. | 299/1 |
| 4,303,994 | 12/1981 | Tanguy | 175/45 |
| 4,361,192 | 11/1982 | Trowsdale | 175/45 |
| 4,393,485 | 7/1983 | Redden | 73/151 |

FOREIGN PATENT DOCUMENTS

| | | | |
|---|---|---|---|
| 2062416 | 5/1981 | United Kingdom | 175/45 |

*Primary Examiner*—Howard A. Birmiel
*Attorney, Agent, or Firm*—William J. Miller

[57] ABSTRACT

The present invention relates to a program controlled apparatus for providing rapid calibration and update of sensor parameters in a push drill guidance apparatus which is remotely controllable from microprocessor circuitry. A special calibration program is set into non-volatile memory for coaction with the control processor to compute sensor parameters for storage and recall during normal programmed guidance operation.

3 Claims, 8 Drawing Figures

PUSH DRILL GUIDANCE INDICATION APPARATUS

CROSS-REFERENCE TO RELATED APPLICATION

This application is a continuation-in-part of U.S. patent application Ser. No. 89,008 as filed on Oct. 29, 1979 and entitled "Push Drill Guidance Indication Apparatus".

BACKGROUND OF THE INVENTION

1. Field of the Invention

The invention relates generally to drilling machine guidance systems and, more particularly, but not by way of limitation, it relates to an improved calibration system for use with a push drill guidance system as utilized in horizontal drilling operations.

2. Description of the Prior Art

There are numerous prior art guidance systems for use with drilling apparatus, both horizontal drilling machines and vertical or well drilling apparatus. U.S. Pat. No. 3,362,750 discloses a mining apparatus having programmed cutting direction and attitude controls, and this teaching utilizes a comparator for sensing a departure of the cutting machine from its programmed direction thereafter to correct the deviations. U.S. Pat. No. 3,326,008 relates to an electrical gopher which is utilized to bore horizontal cable holes. This device utilizes a plurality of synchro motors to maintain its guidance directions. Still other forms of circuitry are utilized in the prior art, especially that art which is related to position keeping within vertical boreholes and well drilling apparatus; however, none of the prior art approaches are similar to the present circuit apparatus nor do they offer the attendant functions and advantages for operation of a push drill remotely guided through a mineral stratum. U.S. Pat. No. 4,164,871 discloses an instrument package which is integrally connected into the push drill string for control communication back to an operator position. The system utilizes accelerometer sensing to determine pitch and roll of the drill instrument while gamma ray count is utilized to determine vertical positioning of the push drill relative to overlying and underlying rock formation, e.g., shale formations adjacent coal seams. Control signals are then processed in the instrument package for transmission back along a multiple conductor control cable to the operator position, whereupon output indication enables the operator to hydraulically control the push drill to accomplish attitude correction during progression through the mineral stratum.

SUMMARY OF THE INVENTION

This invention discloses an instrument package which gathers the information from roll, pitch, and a 3-position magnetometer along with a gamma counter, and converts the information to a multiplexed signal which is subsequently used to frequency modulate a pulse train. The pulse train is then transmitted down a long cable to a receiving apparatus where the pulse train is processed by a microprocessor which demultiplexes the information, computes the roll, pitch, azimuth and gamma count and displays the computer results on appropriate visual indicators. The operation can, from the displayed data, operate the drill in accordance with procedures already outlined in the prior art.

The push drill instrumentation system as described generally above includes automatic calibration apparatus which is built into the essential control structure such that it can be readily calibrated in the field with a minimum of selected set positions and a minimum of operator time and attention. The microprocessor unit, programmable read-only memory and random access memory of the control unit, is also programmed to include an automatic calibration routine as well as a calibrate attitude setting sub-routine which functions under operator control to derive a plurality of calibration variables which may then be stored in the random access memory. Non-volatile random access memory is included so that calibration variables will be retained during shut-off periods of the machinery and a keep-alive battery or power source is included to maintain the random access information.

GENERAL DESCRIPTION OF THE FIGURES

DETAILED DESCRIPTION OF THE DRAWINGS

Figure 1:
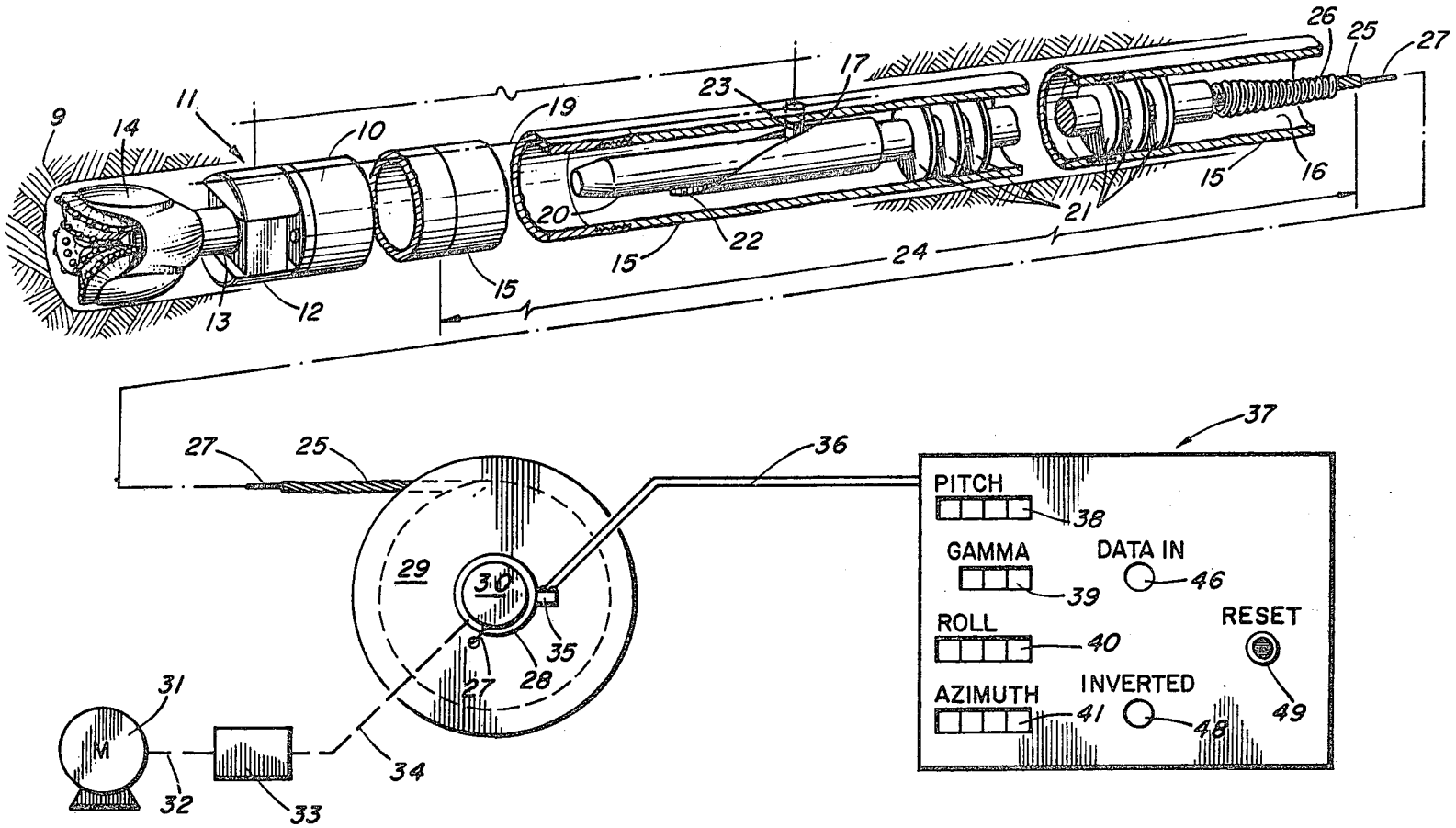
FIG. 1 is a partial cross-section of a drilling unit with instrument package in position and including representative drawings of the reel system and control unit.

Referring to FIG. 1, a cutaway drilling unit or assembly is illustrated having a motor 10, a deflection assembly generally referred to by an arrow 11 which includes a shoe 12. Shoe 12 can be hydraulically deflected by apparatus not shown. A shaft 13 is coupled from the output of motor 10 to a drill bit 14 in the usual manner. A drill string 15 is connected between drill motor 10 and an apparatus located at an accessible location at or near the surface of the earth for axially rotating the drill string to a predetermined angular position (not shown). Such a device is illustrated in FIGS. 16 and 17 of U.S. Pat. No. 3,888,319 and will not be discussed in further detail. Drilling fluid or mud is pumped down the inside of the drill string 15 through an axial opening 16 where the fluid is used to rotate motor 10 and to clear away and remove chips when loosened by drill 14, from around the drill and out of the borehole.

Periodically it is necessary to determine the precise location of the drill with respect to the seam the drill is cutting within. The position of the drill is determined by pumping an instrument package 20 containing remote sensing apparatus or other instruments, later described, using the movement of the drill fluid against a plurality of cups 21 down drill string opening 16 toward motor 10 until the surface of a cam 22 strikes a pin 23 which is attached to the inner wall of drill string 15 and extending into opening 16. Pin 23 and the portion of the drill string between arrows 24 and all materials in the instrument package 20 are preferably made of nonmagnetic material such as stainless steel in order to avoid the introduction of errors into the readings of a magnetometer contained in instrument package 20. The length of the nonmagmetic portion will vary depending upon the diameter of the drill string, for example, and the size of instrument package 20. In the particular embodiment constructed by the invention, for a 2-inch diameter drill string, the portion of the drill string equal to the length of the instrument package 20 (approximately 10 feet) and 10 feet in front of and in back of instrument package 10 were of nonmagnetic material. The main criterion is to sufficiently isolate the magnetometer from magnetic material so that such material will not significantly affect the readings of the magnetometer. Cam 22 is contoured so that no matter which angular position the instrument package 20 strikes the pin, the package will be rotated by the cam and pin, if necessary, until the pin reaches the convergence point 17 of the cam surfaces 22 farthest from the front end of instrument package 20. With the above arrangement, instrument package 20 will always have the same orientation with respect to drill casing 15, thereby generating correlatable data with each insertion of instrument package 20 into drill string 15.

A wire cable 25 is attached through a flex coupling 26 to instrument package 20. A center conductor means 27 is connected internally to instrument package 20 at one end and to a slip ring means 28 at the other end. Slip ring means 28 is attached to reel 29 which in turn is rotatably attached to a shaft 30. A motor 31 is coupled through a mechanical means 32 to a drive system 33 which in turn is coupled through a mechanical means 34 to shaft 30. A brush means 35 in electrical contact with slip ring 28 is connected through wires 36 to a control unit means 37 which includes a microprocessor for computing and programming the control unit 37. It also includes a digital type readout for pitch 38, a gamma count readout 39, a roll readout 40, and an azimuth readout 41. A light 46 for "data in" , a light for "inverted" 48 and a reset switch 49 are also on control unit 37.

General Operation

The device illustrated in FIG. 1 operates by connecting drill motor 10 to a section of drill string 15, to deflection assembly 11 and drill bit 14. The assembled structure is then placed in contact with the ground 9 and drill fluid pumped down the inside axial opening 16 of drill string 15. The movement of the fluid will rotate motor 10 and drill 14 connected thereto. The rotation of the drill bores a hole into ground 9. After a certain distance, it becomes necessary to determine the relative position of the drill with respect to drill string 15 in a coal seam, for example. The shale above and below a coal seam is normally radioactive. The amount of radioactivity can be measured by the usual equipment, such as a gamma ray counter. To make the measurement, the instrument package 20 is inserted into the drill string opening 16. The drill fluid creates a pressure against flexible cups 21 causing the instrument package 20 to be carried along the drill string opening 16 until cam 22 strikes pin 23. No matter where cam 22 impacts pin 23, the cam surface 22 will cause rotation of instrument package 20, clockwise or counterclockwise, until pin 23 reaches the convergence point 17 of the cam surfaces as illustrated in FIG. 1. In the aforementioned position, instrument package 20 is precisely orientated with respect to shoe 12 as illustrated by line 19. As the instrument unit 20 passes through drill string 15, cable 25 unreels from reel 29. When in position, the instrument package is activated by power supplied from control unit 37 through conductor means 36, brushes 35, slip rings 28 and conductor means 27 to instrument package 20. Information from package 20 is transmitted down conductor 27 in the reverse procedure set out above to control unit 37 where the pitch, gamma count, roll and azimuth are calculated and displayed on digital readout devices 38–41, respectively. The invert light 48 is necessary to inform the operator the position of the magnetometer with respect to the horizon. The microprocessor, to be later described, can be programmed to account for the position, therefore, the light is not necessary when so programmed. The "data in" light is merely an indication that the data is in process of being handled by the microprocessor. The "reset" button 49 will cancel the data being processed and start the data reprocessing when a new pulse train is received.

Figure 2:
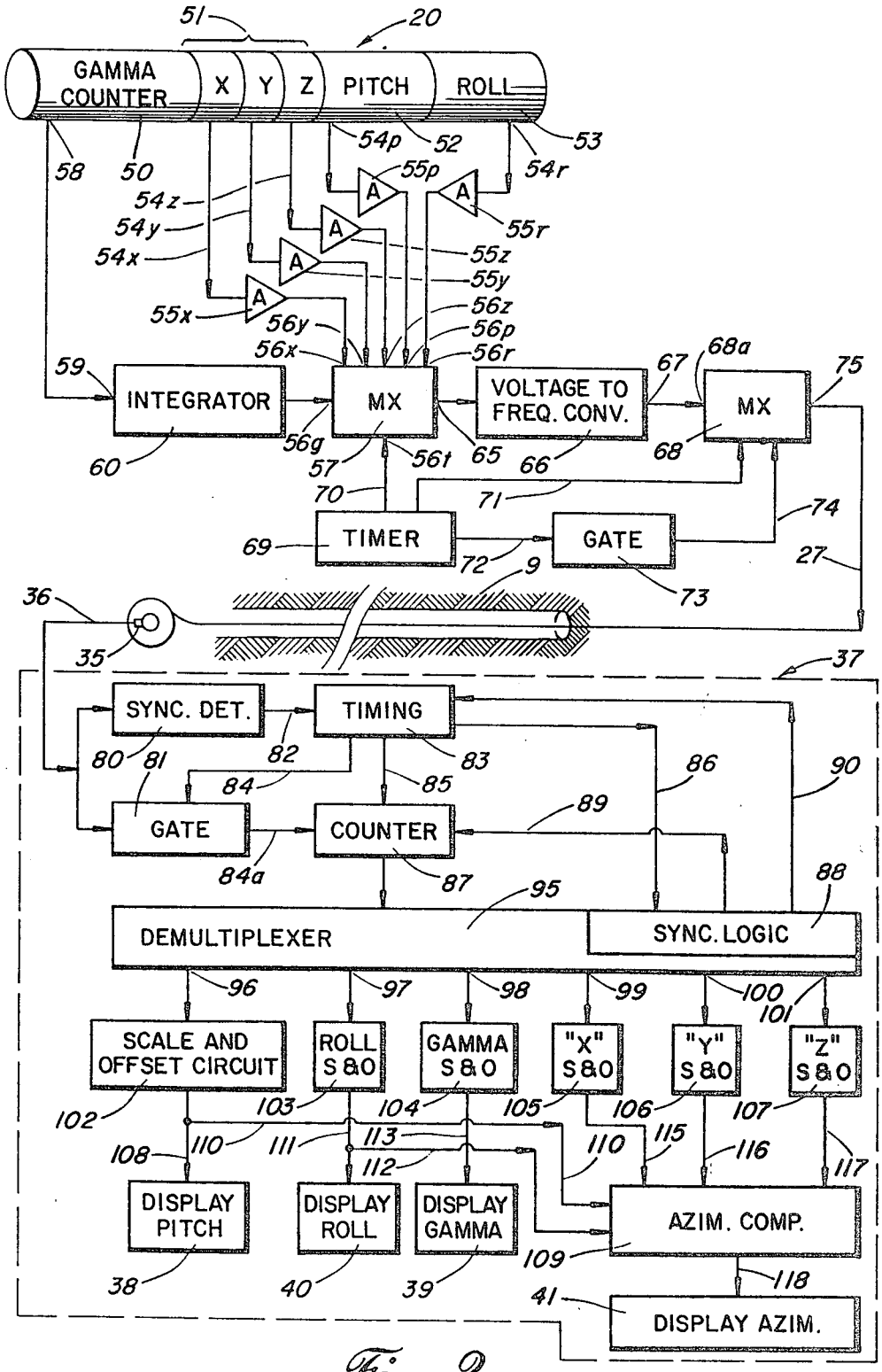
FIG. 2 is a block diagram of the instrument package and control unit circuits.
Figure 3:
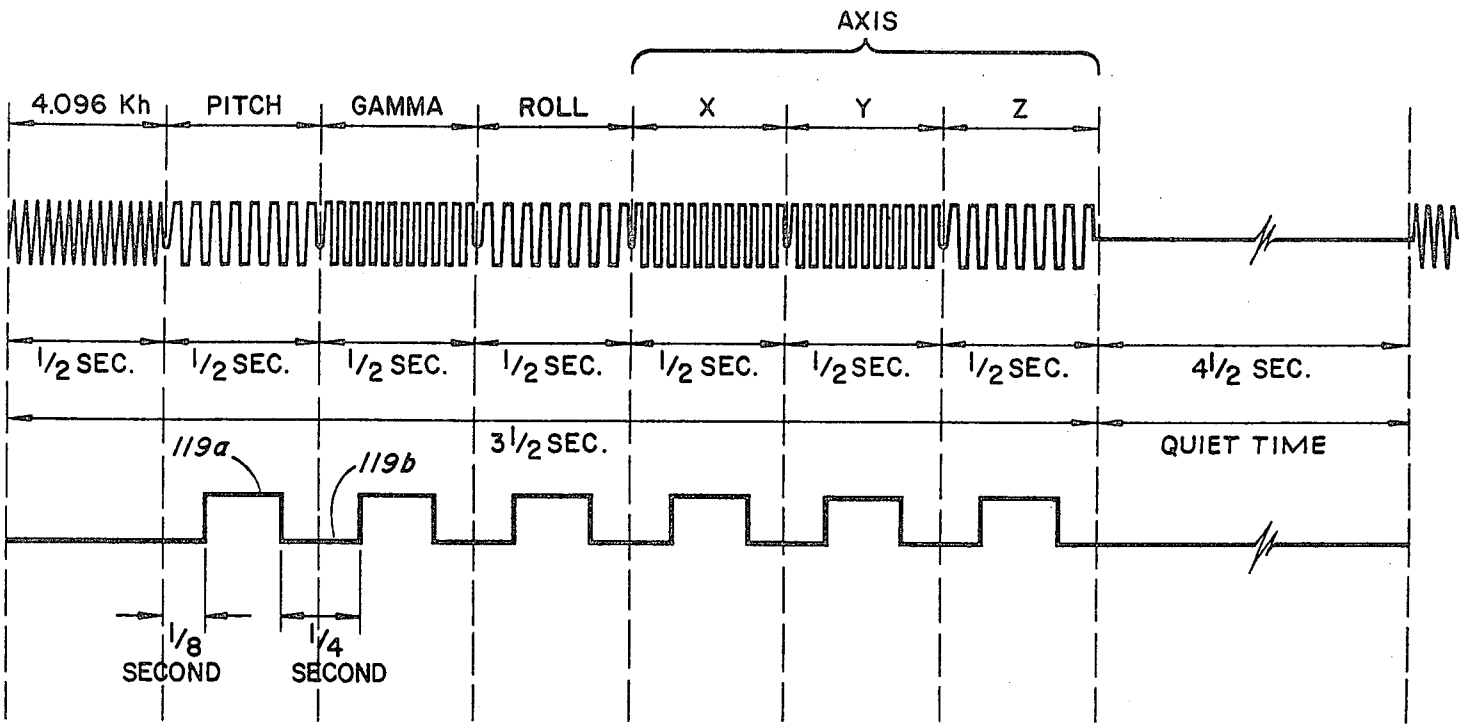
FIG. 3 is a detailed illustration of the pulse train transmitted from the instrument package.
Figure 4:
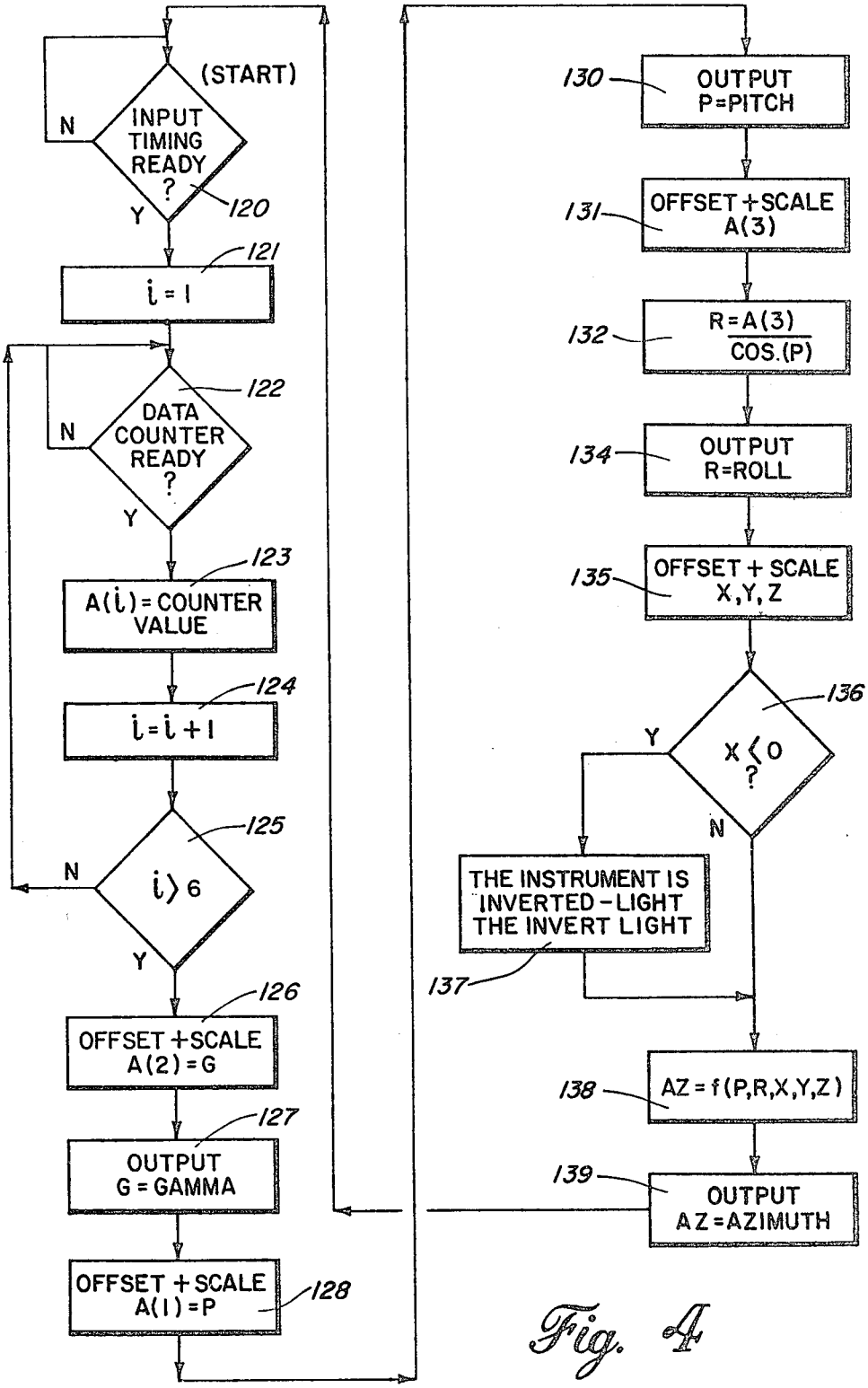
FIG. 4 is a flow diagram of the logic used to operate the microprocessor.

For a detailed understanding of the operation of the invention reference is made to FIGS. 2, 3, and 4. Referring in particular to FIG. 2, instrument package 20 contains a plurality of sensing means which include a gamma counter 50, a 3-axis magnetometer 51, accelerometer 52 used to determine the pitch, and an accelerometer 53 used to determine the roll of instrument 20.

A plurality of outputs 54*x*, 54*y* and 54*z* are coupled through amplifiers 55*x*, 55*y* and 55*z* and conductors to the inputs 56*x*, 56*y* and 56*z*, respectively, of a multiplexor circuit 57. Gamma counter 50 has its output 58 coupled to an input 59 of an integrator 60. An output of integrator 60 is coupled to an input 56*g* of multiplexor 57. The outputs 54*p* and 54*r* of the pitch and roll accelerometers 52 and 53, respectively, are coupled through amplifiers 55*p* and 55*r* to a pair of inputs 56*p* and 56*r* of multiplexor 57. The multiplexed output 65 of multiplexor 57, which is in analog form, is coupled to a voltage to frequency converter 66 which has its output 67 coupled to an input 68*a* of a second multiplexor 68. A timing circuit 69 has an output coupled through a wire 72 to a gating means or gate 73. The output from gate 73 is coupled through a wire 74 to second multiplexor 68. Output 75 from multiplexor 68 is connected to the conductor 27 which is in the cable 25 (see FIG. 1) and is coupled to wire 36 from brush 35 as previously described.

The control unit 37 is essentially a microprocessor with input and output circuits. In its basic function, microprocessor 37 obtains its input from wire 36 and couples it to the inputs of a sync detector 80 and a gate 81. The output from sync detector 80 is coupled through a wire 82 to a timing circuit 83. Timing circuit 83 has outputs coupled through wires 84, 85, and 86 to each of gate 81, a counter 87, and a sync logic circuit 88 which, in turn, has programmed outputs through wires 89 and 90 to the inputs of counter 87 and timing circuit 83.

A demultiplexing circuit 95 has a plurality of outputs 96 through 101 which are coupled to a plurality of scale and offset circuits 102 through 107. "Scale and offset" circuit 102 couples pitch information to a visual indicator unit 38 through wire 108 and to an azimuth computer 109 through wire 110. Output from circuit 103 is coupled through wire 111 to display 40, and through wire 112 to azimuth computer 109. Circuit 104 is coupled through wire 113 to the gamma display circuit 39. The x, y, and z "scale and offset" circuits 105, 106 and 107, respectively, are coupled through wires 115, 116 and 117 to azimuth computer 109. The output from the computer is coupled to the readout apparatus 41 through wire 118.

Operation of the Electronic Circuits

Information in the form of pulses is supplied from gamma counter 50 to integrator circuit 60 where the pulses are added for a fixed interval of time. During the same time period outputs from the x, y, and z axis of the magnetometer 51, the roll and pitch accelerometers 53 and 52, respectively, are amplified in circuits 55*x*, 55*y*, 55*z*, 55*r* and 55*p*, respectively, and supplied to the inputs 56*x*, 56*y*, 56*z*, 56*r* and 56*p*, respectively, of multiplexor 57. The timing circuit 69 at a fixed interval of time, which in the preferred embodiment is 8 seconds, triggers the multiplexor to sample each of the inputs 56*g*, 56*x*, 56*y*, 56*z*, 56*p*, and 56*r* in sequence and supply the information as a continuous single signal comprising a sequence of analog voltages representing the outputs from each of the sensors 50, 51, 52 and 53 to voltage to frequency converter 66. The output 67 is supplied to the second multiplexor 68.

The output from the second multiplexor 68 can best be understood with reference to FIG. 3. Multiplexor 68 first samples for ½ second the information from timer 69 on wire 71 which is a 4.096 kilohertz (kh) signal. The multiplexor is then gated through 73 to open the circuit from voltage to frequency converter 66 on output 67. Since multiplexor 57 connects each of the inputs 56*p*, 56*g*, 56*r*, 56*x* and 56*z* for ½ second, the output signal will contain variable frequency equivalents of the voltage level of each of the sensing elements 50 through 53 in instrument package 20; therefore the 4.096 kh signal which functions as a predetermined recognition or indication means denoting that "data is to follow" is followed sequentially by the data in the form of a pulse train in the form of a variable frequency equivalent of pitch, gamma, roll, x, y, and z. Once the data is complete a 4.5 second period of no signal follows. This no signal or "quiet time" acts as a "flag" to the microprocessor telling the circuit that the next information received is to be handled by the control unit 37. The information is then transmitted along wires 27 and 36 to the microprocessor circuit 37 for processing.

The processing in circuit 37 must take the data from wire 36 in the proper sequence, therefore, the circuit must know when to begin processing. The aformentioned is better explained by referring both to FIGS. 3 and 4. The microprocessing circuit begins to look at the data coming in on wire 36 (FIG. 2). The timing ready process 120 looks at the incoming signal. If a signal is present a "no" response is generated and the circuit recycles and looks at the input again. When the input eventually has no signal (the end of the data from the z axis) the input is in the "quiet time" and the circuit signals "yes" to the input timing ready function 120. Once the pulse train is again received at the input to the timing ready circuit 120 after a "yes" indication, the sync detector 80 triggers the timer 83 which in turn turns on the counter 87 and opens gate 81. Counter 87 will commence counting the 4.096 kh signal for ½ second or 2048 pulses. Upon reaching the requisite number of pulses, the counter indicates to the microprocessor that the next information to be received is "data". During the ¼ second pause the counter is cleared, the date 81 is closed to prevent the counting of additional data, and the program checks to determine if counter 87 is cleared during function 122.

After ¼ second, the timer 83 generates a pulse 119*a* (see FIG. 3) for a period of ¼ second opening gate 81 passing the pitch signal through wire 84*a* to counter 87. The input to the demultiplexor from counter 87 is transferred to scale and offset circuit 102 which develops an output in proper scale and form for the digital "LED" readout on display unit 38. After the ¼ second time period for pitch data is past, the gate 81 closes for ¼ second 119*b* to insure that the next data are only gamma data. Each subsequent opening of gate 81 transfers a subsequent set of data to the counter 87 which subsequently transfers the counted data to the demultiplexor and to a proper display unit 40, 39, or computer 109. The azimuth computer 109 takes all of the data and calculates the azimuth and displays same on the display unit 41.

Referring to FIG. 4, a flow diagram of the microprocessor circuit is illustrated.

At the onset of the program, the input timing 120 must be ready, that is, the input signal must be in the quiet time (see FIG. 3). If "no", the circuit rechecks until a "yes" is indicated whereupon the index 121 is set to $i=1$. The data counter ready function 122 is then checked to determine if the counter has completed its count for $i=1$ (pitch). If "no", it continues to recheck until a "yes" is received whereupon the counter value 123 is assigned to memory in the $A_1$ location. Once the information $A_1$ is in memory, i is indexed to the next number $i+1$, step 124 and checked to determine if i is greater than 6 (step 125). If less than 6, then the steps beginning with 122 through 124 are repeated for the next data sample, for example, $A_2$ which is gamma information (see FIG. 3) is processed and stored in memory $A_2$ location. All the data is processed and stored in like manner.

When $i>6$, a "yes" response from step 125 is received and the information for $A_2$ is removed from memory and processed (126) for offset and scaling and outputed 127 for gamma data which provides counts per minute on a digital readout apparatus (39 in FIG. 2). When this function is completed, $A_1$ is removed from memory, processed for offset and scaling 128 and outputed for pitch information 130. Next, $A_3$ information in memory is offset and scaled (131) and since it constitutes novel information and since the pitch will affect the data, the pitch information of the tool is processed at 132 in the relationship $R=A(3)/COS.(P)$ to determine the final roll position which is output at 134. The x, y, and z components in memory are then offset and scaled 135 and checked to determine if the vertical component x is less than zero 136. If "yes", then the invert light 48 (see FIG. 1) is energized 137. In either case the azimuth data is then computed 138 and outputed 139. Once the azimuth is outputed 139, the input timing reader 120 is told that computations are complete on the last data and the system is now ready to start again when the next quiet time is detected.

Control Unit Circuitry

Figure 5:
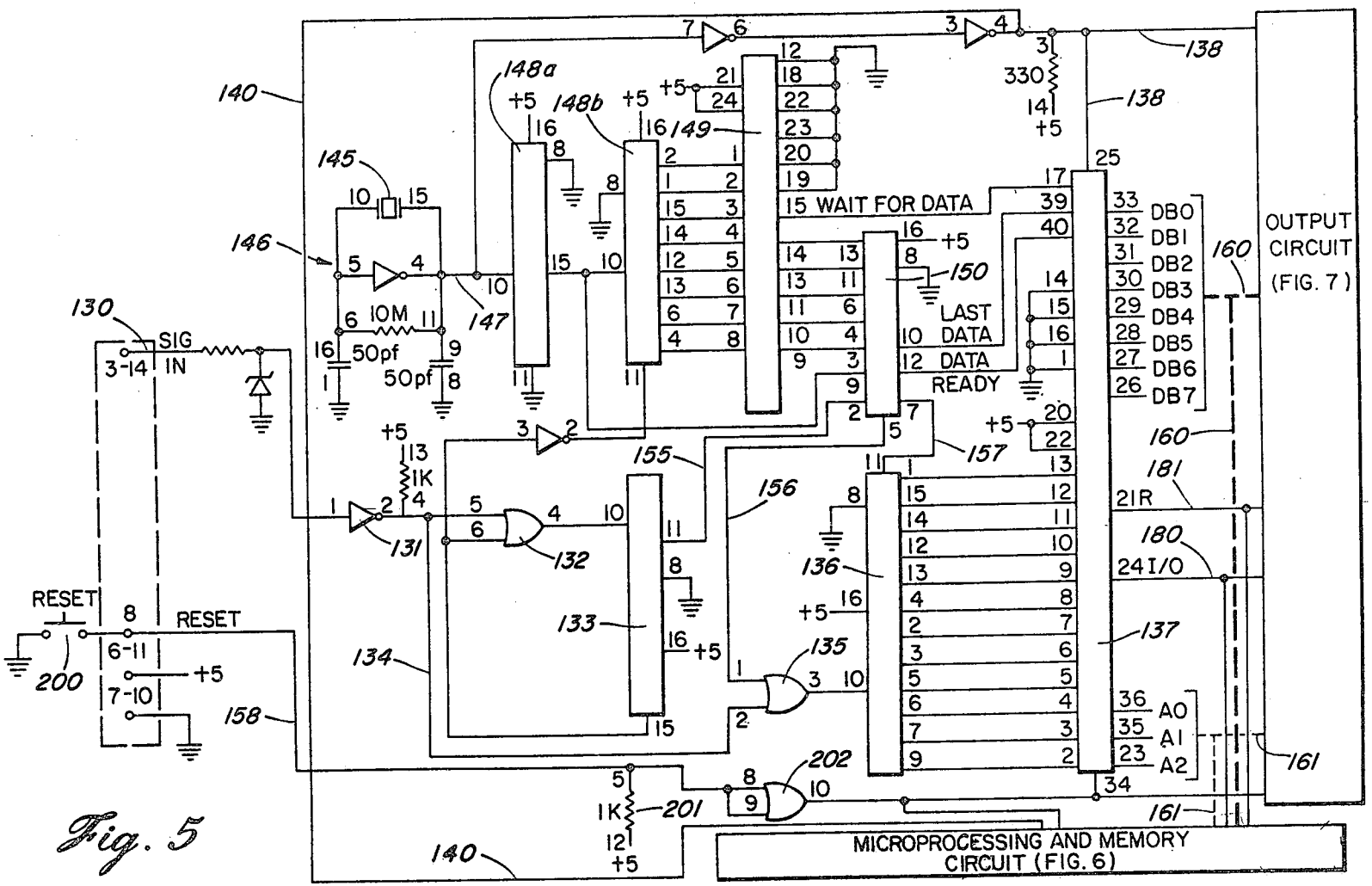
FIG. 5 is a schematic drawing of the input circuit to the control unit.
Figure 6:
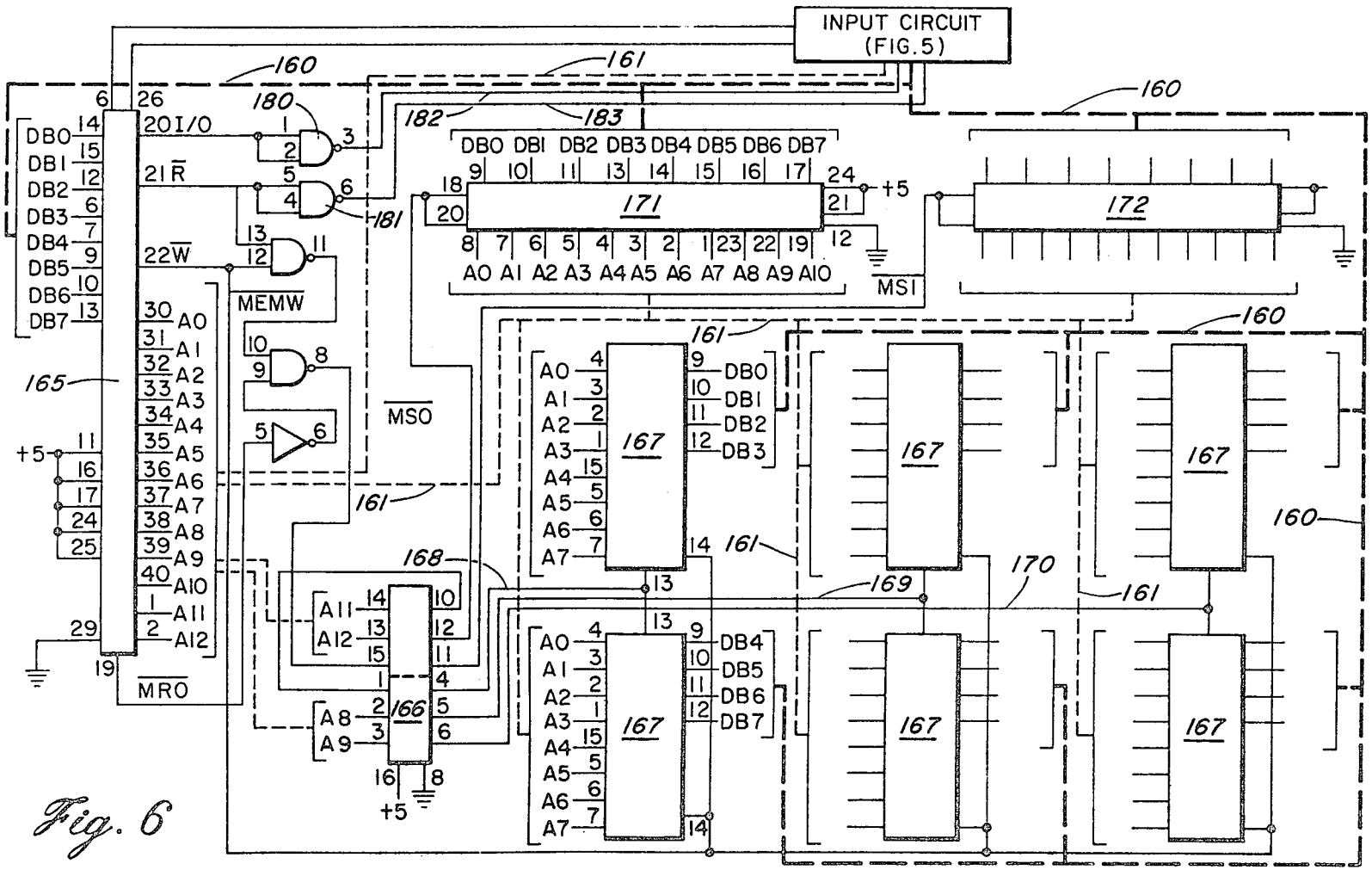
FIG. 6 is a schematic drawing of the microprocessor and memory circuit.
Figure 7:
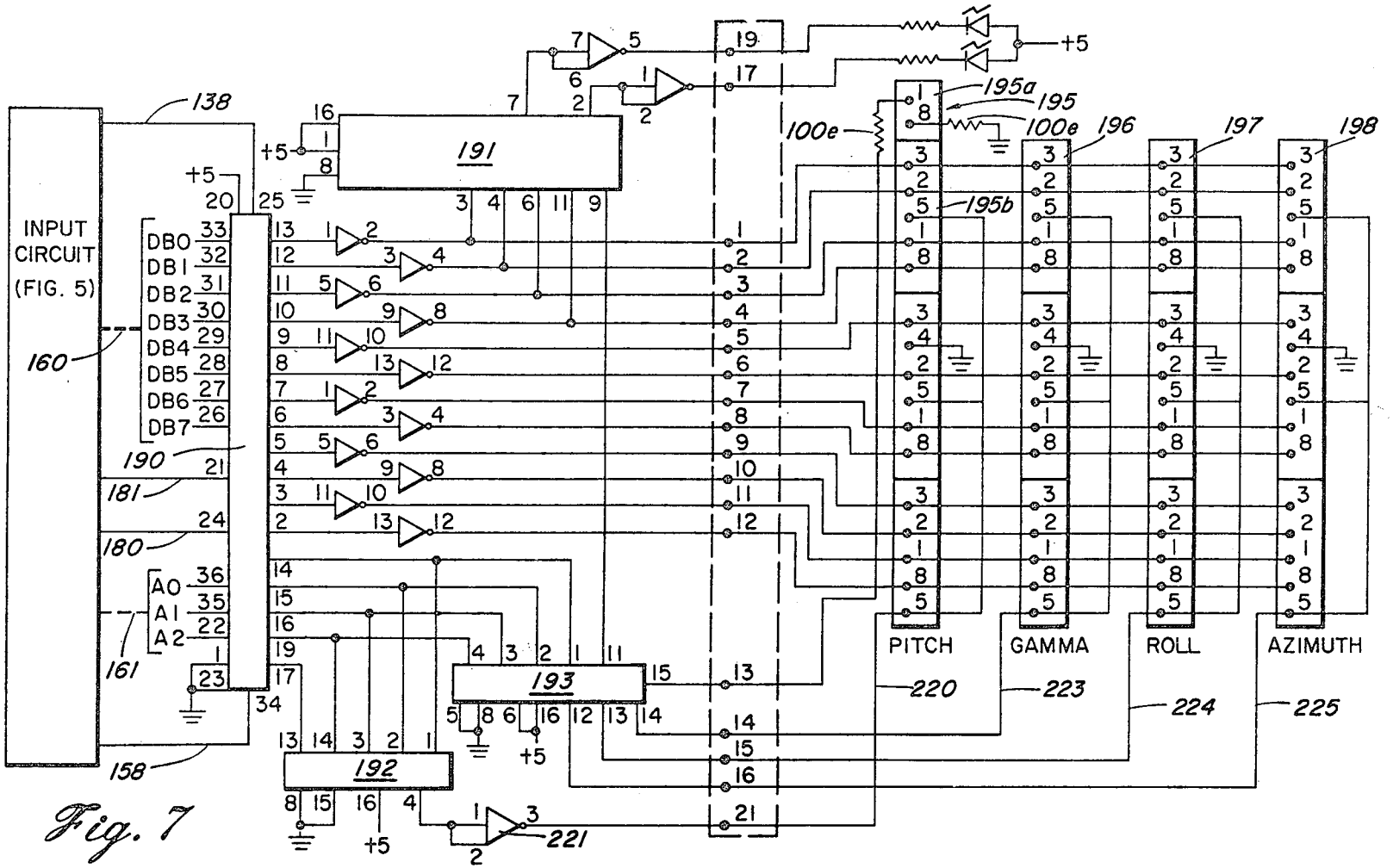
FIG. 7 is a schematic drawing of the output circuit for the control unit.

FIGS. 5 through 7 illustrate the circuitry for an actual control unit which has been constructed according to the teachings of this invention. The input circuit schematic is illustrated in FIG. 5 with the input entering on wire 130 (wire 36 of FIG. 2), through amplifier chip 131, gate 132 to the 4.096 kh counter 133 which is a Type 4040 integrated circuit (IC) chip. The input also passes along wire 134 through a gate 135 to the data counter 136 which is a Type 4040 (IC) chip. The output from counter 136 passes to a Type 6820 interface chip 137 connected to the microprocessing circuit (FIG. 6) through data buss 160, address buss 161, control wires 180 and 181 and timing connection 138 to the chip 137 and to chip 190 (see FIG. 7). A timing signal is also supplied through wire 140 to MPU 165 (see FIG. 6).

The timing circuit necessary to operate the circuits comprises a crystal 145 having a frequency of 1.048567 mhz and associated circuits 146. The output is coupled through a wire 147 to a pair of counters 148*a* and 148*b* which divide the frequency generated by crystal 145 and apply the lower frequencies to a Type 6820 (IC) chip decoder 149 which generates the properly timed pulses for operating the system, for example, see pulses 119*a* and 119*b* in FIG. 3. The output from decoder 149 is applied to a latch, Type 54LS174 (IC) chip, which is also connected to interface chip 137. Signals from the timer are communicated on wires 155, and 157 to counters 133, 136 and gate 135. Wire 158 communicates a "reset" command to the interface chip of the microprocessing and memory circuit (FIG. 6), and the output circuit (FIG. 7). Operation of the circuit is substantially as described in FIGS. 2 through 4. A reset capability is possible by a circuit comprising a push button 200 along wire 158. A resistor 201 maintains a positive voltage on gate 202 which is dropped to ground potential when reset button 200 is depressed. Pin 10 of gate 202 is then dropped to ground potential which grounds pins 34 and IC's 137, 190 (see FIG. 7), and pin 26 of the microprocessor unit 165 (see FIG. 6).

Referring to the microprocessing and memory circuit of FIG. 6 and the input circuit of FIG. 5, data is transferred between the interface chip 137 and the computing and memory circuits, and the output circuits on data buss 160 which is in reality a bundle of eight wires interconnected in accordance with the numbers DB0, DB1, . . . DB7, following the brackets at the terminus of each heavy dashed line 160. Note that identical chips will not be numbered to save space, but the interconnections are identical. The address information for each chip is communicated along address buss 161 which is a bundle of wires interconnected in accordance with the numbers $A_0$, $A_1$, $A_2$, etc., by each bracket at the terminus of the narrow dashed line 161.

The microprocessing circuit (MPU) 165 is a Type Z80. Address information from $A_9$, $A_{10}$, $A_{11}$, and $A_{12}$ are connected to the selector control chip 166 which is a Type 54LS139. It controls which of the random access memory chips (RAM Type 2112 N-1) 167 is to be used through wires 168, 169 and 170. The address control from MPU 165 for each RAM is along address buss 161. Selector control chip 166 also determines which programmable read only memory chip (PROM) 171 or 172 is selected. As previously described, address buss 161 connections are determined by the numbers by the brackets $A_0$, $A_1$ . . . $A_{10}$ at the terminus of the buss 161. A signal or a lack of a signal will be determined at terminal 23 on chip 137. Additional instructions are transmitted through inverter chips 180 and 181 from MPU 165 through wires 182 and 183 to terminals 21(R) and 24 (I/O) of chip 137 and output chip 190 (see FIG. 7). The particular program to operate the circuit of FIG. 6 in interconnection with FIG. 5 and FIG. 7 is already described in FIG. 4.

The output circuit is illustrated in FIG. 7 and includes a peripheral interface adapter (PIA) 190 which is a Type 6820 (IC). A latching (IC) which is a Type 54LS174, a decoder latching (IC) 192 which is a Type 4724, a selector (IC) 193 which is a Type 54LS138, and four numerical display units 195, 196, 197 and 198. Unit 195 differs from the other display units since it comprises two portions 195*a* and 195*b*. Display unit 195*a* is a "+" or "−" sign and pin 4 is grounded to form a decimal point. All the pins in 195*b*, 196, 197 and 198 are identical and connected identical with the exception of pin 5 which will be subsequently explained. Data on buss 160 inputs to PIC unit 190 which determines the manner of lighting of the various display units 195–198. The "+" or "−" on unit 195*a* is determined by decoding latching unit 192 which is coupled to pin 1 of unit 195. The negative sign is on all the time and the positive bar is energized in response to data from the latching (IC) 192. the numerical display unit 195 is a Type 5082-7304 and the units 196, 197 and 198 are Type 5082-7300. Not shown are pins 6 which are converted to ground and pin 7 which is connected to a +5 volts. The balance of the interconnections are not described in detail since they are well known to those skilled in the art and clearly determined from the drawings.

It is obvious that the microprocessor, once it has the data $A_1$ through $A_6$ in memory, can compute the data in any logical order. The invert light 48 is also not necessary, since the microprocessor can add 180° to the data automatically if the instrument is detected as being inverted.

Pins 5 of unit 195 are coupled through wire 220 and amplifier 221 to latching unit 192, while pins 5 of unit 196 are coupled through wire 223 to selector 193. Units 197 and 198 are, likewise, coupled through wires 224 and 225, respectively, to selector 193. In operation information from the microprocessor unit of FIG. 6 addresses the selector 193 and latching unit 192 so that they can energize the proper sequence of display numbers on the display units 195 through 198.

The above-described push drill and guidance indication apparatus is adapted to utilize stored-in read-only memory parameters that are related to the calibration of the sensors. The read-only memory is located in the display and computation unit or control unit 37, and these parameters are initially obtained by measurement of the sensor outputs when the push drill is placed in various attitudes in order to derive offsets and scale factors. Thus, the parameters derived and stored are unique to the particular sensors measured so that the display unit 37 and sensor unit within the push drill must be operated as a matched set and components are not interchangeable as between instrumentation sets.

Measurement of the sensor parameters and programming of the read-only memory in early practice was an extremely long and tedious job to be carried out only by skilled technicians. A calibration system is utilized which is of the type wherein the instrument can be placed in a selected position, calibration can then be recorded, and all reading subsequent thereto will be referenced to that position. Previously, when one of the individual sensors within the sensor unit had to be adjusted or replaced, the entire readout unit was required to be reprogrammed in relation to the replacement sensors, and such reprogramming required return to the laboratory for extensive and time consuming operations.

The prior mentioned problems are eliminated in the present invention by using the computational power of the microprocessor (FIG. 6) in the control unit 37 in order to measure and compute sensor parameters and then to store these parameters in non-volatile random access memory, i.e. memory that retains contents when all power is removed. The display and sensor units are then self-aligning.

Figure 8:
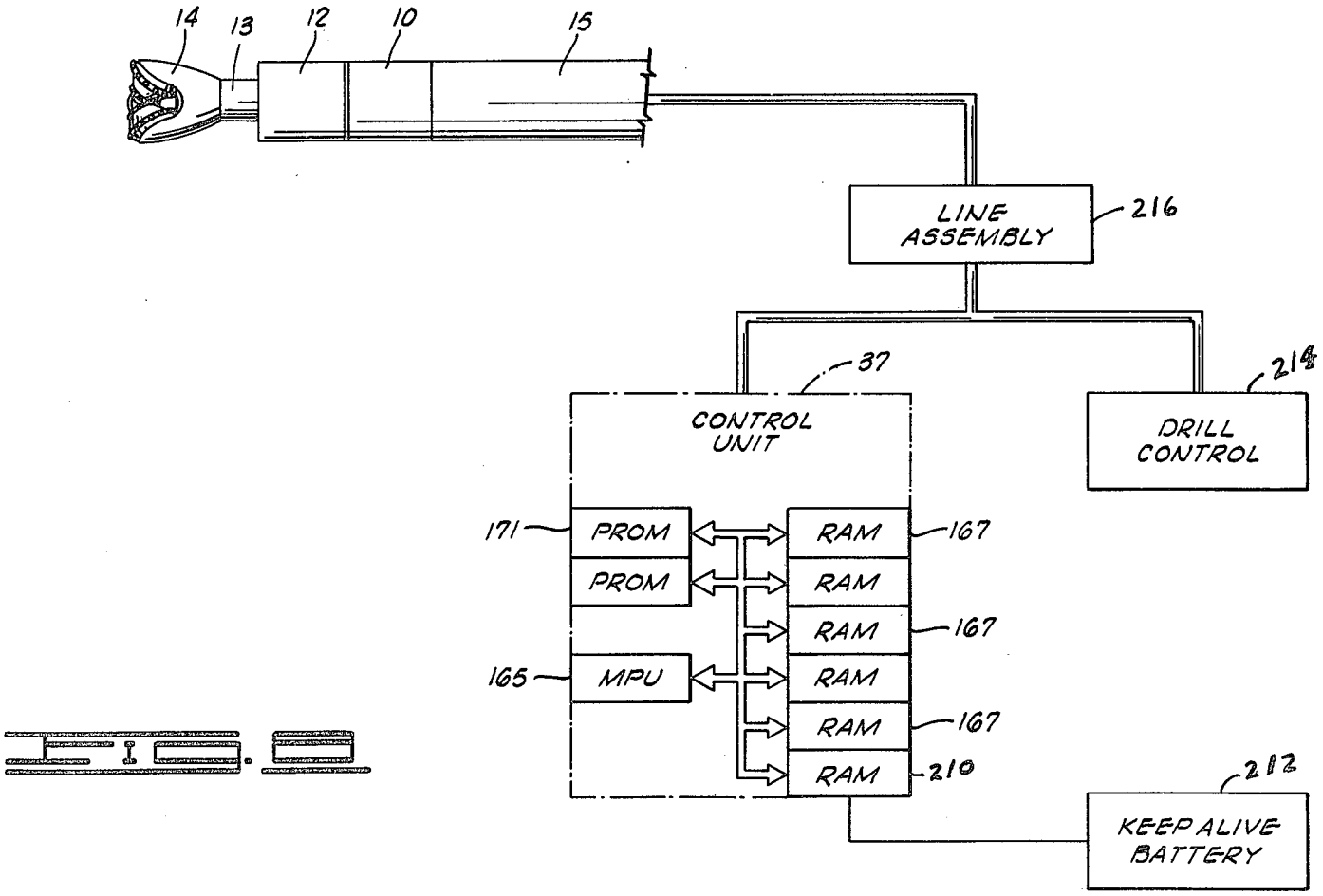
FIG. 8 is a block diagram of the complete apparatus including push drill, control unit and the operator's drill control.

Thus, referring to FIG. 8, an additional CMOS random access memory 210 is included in the micrprocessor portion of control unit 37 in address connection through the primary buss circuitry, and the RAM 210 provides storage for the various sensor unit parameters. A keep-alive battery 212 is also included in connection with the RAM 210 so that stored parameter contents of RAM 210 will be retained whenever power is turned off. The non-volatile memory RAM 210 may be such as a complementary MOS Intel type 5101 Random Access Memory and the battery 212 is such as a service quality dry cell that provides the necessary keep-alive voltage, e.g. from 2 volts to $4\frac{1}{2}$ volts D/C. Manual control of the push drill is accomplished in conventional manner by operator control of the drill control 214 which is located at the display or control unit 37 with connection via the line assembly 216 which provides cable interconnection to the push drill.

The display or control unit 37 provides for two modes of operation, i.e. normal or calibrate. In the normal or operate mode, previously stored sensor parameters in the RAM 210 are retrieved by the microprocessor unit 165 for computation of pitch, roll, and magnetic heading of the push drill unit. When switched to the calibrate mode, the control unit 37 can function to update the sensor parameters. Thus, in the calibrate mode, the operator may orient the push guide assembly, and hence the instrument package 20, successively, in a plurality of different prescribed attitudes while the microprocessor unit 165 interrogates successive sensor outputs for computation of parameters. These sensor parameters are then stored in the CMOS RAM 210 so that they may be called upon at any time subsequent for use in the sensor read-out processing.

A permanently stored digital processing program in Fortran language is stored in the RAM 210 and is identified as sub-routine calibrate. A listout of sub-routine calibrate including operation at each selected control position or attitude is as follows:

```
000100        SUBROUTINE CALSB
000110  C     MODIFIED FOR ADDITIONAL PITCH+ROLL SCALE FACTORS
000120        COMMON/CONST/ZB,YB,XB,ZSC,YSC,XSC,PITSC,ROLSC,GMASC,GMAB
000130  +     ,ROLB,PITB,PIV,PAZ,ROLBI,ROLSCP,ROLSCM,PITSCP,PITSCM
000140        COMMON/PORTID/IPO,IP1,IP2,IP3,IP4,IP5,IP6,IP7
000150        COMMON/ASI/A(7)
000160  C     CALIBRATE SUBROUTINE-GOES THROUGH THE 8 STEP
000170  C     CALIBRATE SEQUENCE IF THE CAL SWITCH IS ON
000180  C     OTHERWISE SETS THE PARAMETERS.
000190  C
000200  C
000210        IF(INPFN(IP3).AND.32) 1,1,100
000220  C     CAL SWITCH ON?
000230  1     CONTINUE
000240  33    IF(INPFN(IP3).AND.64) 34,34,33
000250  34    CONTINUE
000270  C     START 8 STEP CAL SEQ.
000280  C
000290  C     UP SIDE DOWN AND BACKWARD
000300        CALL OUT(IP7,65)
000320  2     IF(INPFN(IP3).AND.64)2,2,3
000330  3     CALL OUT(IP7,64)
000340        CALL INPUT
000350        X1=A(4)
000360        CALL OUTPUT(X1,1)
000370        PD=A(1)
000380        RD=A(3)
000390  C
000400  C     RIGHT SIDE UP AND BACKWARD
000410        CALL OUT(IP7,68)
000420  30    IF(INPFN(IP3).AND.64) 30,30,4
000430  4     CALL OUT(IP7,64)
000440        CALL INPUT
000450        X2=A(4)
000460        CALL OUTPUT(X2,1)
000470        Z1-A(6)
000480        Y1=A(5)
000490  C
000500  C     PITCH DOWN 10 DEGREES BACKWARD
000510        CALL OUT(IP7,67)
000520  21    IF(INPFN(IP3).AND.64)21,21,22
000530  22    CALL OUT(IP7,64)
000540        CALL INPUT
000550        PM=A(1)
000560  C
000570  C     FORWARD 0 PITCH 0 ROLL
000580        CALL OUT(IP7,69)
000590  5     IF(INPFN(IP3).AND.64) 5,5,6
000600  6     CALL OUT(IP7,64)
000610        CALL INPUT
000620        Y2=A(5)
000630        Z2=A(6)
000640        P0=A(1)
000650        R0=A(3)
```

-continued

```
000660  C
000670  C     FORWARD 0 PITCH 90 DEGREES ROLL
000680        CALL OUT(IP7,72)
000690  7     IF(INPFN(IP3).AND.64)7,7,8
000700  8     CALL OUT(IP7,64)
000710        CALL INPUT
000720        P90=A(1)
000730  C
000740  C     FORWARD 10 DEGREES PITCH 0 ROLL
000750        CALL OUT(IP7,73)
000760  9     IF(INPFN(IP3).AND.64) 9,9,10
000770  10    CALL OUT(IP7,64)
000780        CALL INPUT
000790        P10=A(1)
000800  C
000810  C     FORWARD 0 PITCH 30 DEGREES ROLL
000820        CALL OUT(IP7,76)
000830  11    IF(INPFN(IP3).AND.64)11,11,12
000840  12    CALL OUT(IP7,64)
000850        CALL INPUT
000860        R30=A(3)
000870  C
000880  C     FORWARD 0 PITCH 330 DEGREES ROLL
000890        CALL OUT(IP7,77)
000900  41    IF(INPFN(IP3).AND.64)41,41,42
000910  42    CALL OUT(IP7,64)
000920        CALL INPUT
000930        RM=A(3)
000940  C
000950  C
000960  C     SETUP PARAMETERS
000970  100   CONTINUE
000980        CALL OUT(IP7,64)
000990        ZB=(Z1+Z2)/2.
001000        YB=(Y1+Y2)/2.
001010        XB=(X1+X2)/2.
001020        PITB=P0
001030        ROLB=R0
001040        GMASC=.3
001050        GMAB=220
001060        PITSCP=.17365/(P10-P0)
001070        PITSCM=.17365/(P0-PM)
001080        ROLSCP=.5/(R30-R0)
001090        ROLSCM .5/(R0-RM)
001100        ZSC=-1.0
001110        YSC=-1.0
001120        XSC-—1.0
001130        PIV=PD-P0
001140        PROL=P90-P0
001150        PAZ=PROL-PIV/2.0
001160        ROLBI=RD
001170        A(1)=P0
001180        A(2)=R0
001190        A(3)=XB
001200        A(4)=YB
001210        A(5)=AB
001220        RETURN
001230        END
*
```

The foregoing discloses a novel method and apparatus which provides for rapid and reliable calibration of a microprocessor controlled push drill guidance system. The system is adapted to include permanent, non-volatile storage means for retention of the calibration program, and keep-alive voltage source is provided to energize such permanent storage independent of the operation and control of the push drill and guidance assembly. The invention provides a unique microprocessor control of system calibration, wherein sensor parameters used to compute pitch, roll and magnetic heading are readily retained and updated to enable rapid calibration and/or corrective adjustment.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. Push drill guidance apparatus for remotely controlling position and attitude of a push drill within an earth borehole, said push drill carrying a plurality of sensors providing data outputs of gamma count, X, Y and Z axis orientation, pitch and roll of the push drill, such data outputs being conducted to a remote control unit which also includes data indicators and drive means for manually controlling said push drill position and attitude, the apparatus further comprising:

multiplexing means at said push drill for generating time sequential, frequency indicative signals for each of said sensors for transmission to the remote control unit;

microprocessor means at the remote control unit for receiving and demultiplexing said time sequential signals to compute and provide output and display of the plural sensor data outputs;

non-volatile random access memory means addressably coacting with said microprocessor means storing sensor parameter data for each of said sensors;

a keep-alive voltage source continually energizing said random access memory means; and means enabled in calibrate mode to activate calibrate program of said microprocessor means whereby the sensor parameters for each sensor in each of a plurality of prescribed push drill attitudes is re-calibrated and the updated sensor parameters are stored in said random access memory means.

2. Push drill guidance apparatus as set forth in claim 1 wherein said microprocessor means further comprises:

programmable read only memory means containing normal mode operate program and being addressably interconnected with the microprocessor unit and additional random access memory.

3. Push drill guidance apparatus as set forth in claim 2 which is further characterized to include:

switch means at said remote control unit for enabling one of normal and calibrate modes of operation; and drill control means at said remote control unit for controlling placement of the push drill in plural prescribed attitudes during calibrate mode for computation of the plural sensor parameters.

* * * * *